US006279525B1

(12) United States Patent
Speil

(10) Patent No.: US 6,279,525 B1
(45) Date of Patent: Aug. 28, 2001

(54) CAM FOLLOWER FORMED WITHOUT REMOVING ANY MATERIAL

(75) Inventor: Walter Speil, Ingolstadt (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/554,240

(22) PCT Filed: Oct. 7, 1998

(86) PCT No.: PCT/EP98/06381

§ 371 Date: Jun. 19, 2000

§ 102(e) Date: Jun. 19, 2000

(87) PCT Pub. No.: WO99/25958

PCT Pub. Date: May 27, 1999

(30) Foreign Application Priority Data

Nov. 13, 1997 (DE) ..... 197 50 206

(51) Int. Cl.[7] ..... F01L 1/18

(52) U.S. Cl. ..... 123/90.41; 123/90.42; 74/559

(58) Field of Search ..... 123/90.39, 90.4, 123/90.41, 90.42, 90.43, 90.44, 90.45, 90.46; 74/519, 559

(56) References Cited

U.S. PATENT DOCUMENTS 2,943,612 7/1960 Middler ..... 123/90.41
5,016,582 * 5/1991 Mills ..... 123/90.39
5,775,280 * 7/1998 Schmidt et al. ..... 123/90.41

FOREIGN PATENT DOCUMENTS 19617668 11/1997 (DE) .
19630775 2/1998 (DE) .
586819 4/1993 (JP) .

* cited by examiner

*Primary Examiner*—Weilun Lo
(74) *Attorney, Agent, or Firm*—Bierman, Muserlian and Lucas

(57) ABSTRACT

A finger lever for a valve train of an internal combustion engine, said finger lever being made by shaping without chip removal and comprising two side walls (5,6) which are connected to each other in a first end region (1) by a first bottom wall (4) to form an upwardly open U-shape, the first bottom wall (4) comprising a downwardly facing semi-spherical recess (7) for receiving a support element, said side walls (5,6) being connected to each other in a second end region (2) by a second bottom wall (11) to form an upwardly open U-shape, said second bottom wall (11) comprising a contact surface for a valve stem of a gas exchange valve (12), and the contact surface comprising lateral guides spaced apart from each other characterized in that, in the region of the contact surface of the valve stem (12) and/or in the region of the semi-spherical recess (7), the side walls (5,6) comprise partially punched-out sections (14) that are bent through nearly 180° toward the valve stem (12) and/or toward the support element respectively, so that retaining tabs (13) are formed for the lateral guidance of the finger lever on the valve stem (12) and/or on the support element

9 Claims, 1 Drawing Sheet

CAM FOLLOWER FORMED WITHOUT REMOVING ANY MATERIAL

This application is a 371 of PCT/EP98/06381 filed Oct. 7, 1998.

FIELD OF THE INVENTION

The invention concerns a finger lever for a valve train of an internal combustion engine, said finger lever being made by shaping without chip removal and comprising two side walls which are connected to each other in a first end region by a first bottom wall to form an upwardly open U-shape, the first bottom wall comprising a downwardly facing semi-spherical recess for receiving a support element, said side walls being connected to each other in a second end region by a second bottom wall to form an upwardly open U-shape, said second bottom wall comprising a contact surface for a valve stem of a gas exchange valve, and the contact surface comprising lateral guides spaced apart from each other.

BACKGROUND OF THE INVENTION

A generic finger lever of the pre-cited type having lateral guides is known from U.S. Pat. No. 5,016,582. These guides bear against the valve stem of a gas exchange valve and have the function of guiding the finger lever laterally, i.e. they prevent the finger lever from slipping off the valve stem. These lateral guides are formed by a doubling of the side walls, i.e. the side walls merge at their lower ends into parallel, upwardly extending inner side walls that are connected to each other by a bottom wall. In this way, a downwardly facing recess is formed in the finger lever for the valve stem, said recess being defined by the two inner side walls and the bottom wall.

A drawback of this finger lever is that this type of lateral guidance necessitates a complicated shaping procedure and the finger lever has a large mass due to the doubling of the side walls.

SUMMARY OF THE INVENTION

It is therefore an object of the invention to provide an improved finger lever whose lateral guides are substantially simpler to manufacture.

The invention achieves this object in that, in the region of the contact surface of the valve stem and/or in the region of the semi-spherical recess, the side walls comprise partially punched-out sections that are bent through nearly 180° toward the valve stem and/or toward the support element respectively, so that retaining tabs are formed for the lateral guidance of the finger lever on the valve stem and/or the support element.

The advantage of this solution is, on the one hand, that the retaining tabs serving as lateral guides can be made with a negligible amount of additional work compared to the prior art by a simple punching and bending operation as a part of the general manufacturing process. On the other hand, the mass of the lever can be reduced because the retaining tabs originally form a part of the side walls and do not have to be formed out of additional material. Still another advantage is that the retaining tabs can be arranged both in the end region of the valve stem and in the end region of the support element. While the arrangement in the end region of the valve stem is intended mainly for the lateral guidance of the finger lever on the valve stem, retaining tabs in the end region comprising the semi-spherical recess are to be understood as lateral safety devices for mounting that prevent a lateral tilting of the lever when it is brought into place before the mounting of the camshaft. Such a tilting would otherwise be possible due to the fact that the center of gravity of the lever as a whole is situated distinctly higher than the points of support.

The upper boundary of the punched-out section is situated below the upper edge of the side walls This means that the side walls from which the retaining tabs are punched out are not completely severed. This assures that a residual cross-section remains in the upper part of the side walls so that an adequate rigidity is maintained in the region of the pressure zone of the finger lever.

The shape of the upper edge of the side walls in the region of the punched-out section is matched to the profile of the punched-out section. This means that the side walls follow the profile of the punched-out section so that, for example, if the punched-out section has an arcuate configuration, the side walls will also have an arcuate shape. This enlarges the residual cross-section of the side walls and thus enhances the stability of the lever.

According to a further feature of the invention, the residual cross-section of the side wall formed by the partially punched-out section is displaced into the pocket by the bent-over retaining tab. Thus, by a simple shaping operation, for example pressing, this residual cross-section is displaced toward the valve stem or toward the support element respectively, so that, on the one hand, the large cross-section which favors stiffness is approximately maintained and, on the other hand, possible problems in free movement due to the enveloping circle of the cam, especially in the case of miniaturized levers, are avoided.

According to a further additional feature of the invention, the retaining tabs may have a rectangular, a trapezoid or a semicircular configuration. These are all equally efficient forms and the choice depends only on tool availability and suitability for the particular case of use. One factor to be kept in mind when choosing the shape of the retaining tab is that the most favorable possible distribution of stress in the residual cross-section should be achieved.

The retaining tabs may be subjected to an after-treatment of stamping. By this is meant that a modification of the cross-section is effected by a subsequent shaping process, so that the surface area of the retaining tab is enlarged, for example, by ironing.

It can be advantageous if the retaining tabs are parallel to or are bent to extend at a defined angle to the side walls. If the retaining tabs are parallel to the side walls, they are advantageously arranged inwardly offset from the side walls.

Finally, the upper edges of the side walls in the region in front of and behind the retaining tabs is bend inward at a right angle. This inward bending makes up for the loss of stiffness caused by the punching out of the retaining tabs.

The invention will now be described more closely with the help of the following example of embodiment.

DETAILED DESCRIPTION OF THE DRAWINGS

Figure 1:
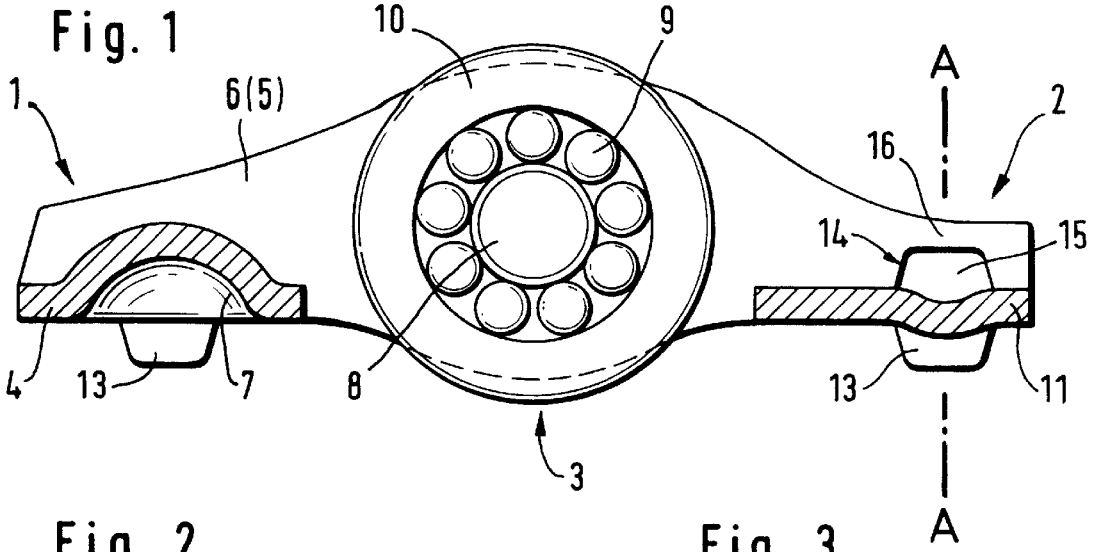
FIG. 1 shows a side view of a finger lever, partly in section.

The finger lever shown in FIGS. 1 to 4 is a sheet metal part made by a shaping process without chip removal and comprises the two end regions 1 and 2 and a central region 3. The end region 1 comprises a first bottom wall 4 from which two side walls 5 and 6 extend in an upwardly open U-shape from the entire length of the finger lever. The bottom wall 4 comprises a downward facing semi-spherical recess 7 that rests on a support element, not shown. In the central region 3, the side walls 5 and 6 comprise two axially aligned bores in which a cam roller 10 loaded by a cam is rotatably mounted through a rolling element crown ring 9 on a pin 8. In the end region 2, the side walls 5 and 6 are connected to each other by a second bottom wall 11 and likewise form an upwardly open U-shape. A gas exchange valve 12 arranged in this region 2 bears with its stem against the bottom wall 11 and opens when the finger lever is caused to pivot by the cam.

As can be seen further in the figures, the side walls 5 and 6 comprise in the end regions 1 and 2, i.e. in the region of the support element and in the region of the gas exchange valve 12, retaining tabs 13 which serve for a lateral guidance of the finger lever on the gas exchange valve 12 and on the support element respectively. The retaining tabs 13 are formed by partially punched-out sections 14 in the region of the side walls 5 and 6. By this is meant a severing of material with retention of a material continuity of the side walls 5 and 6 at one point. By a bending-over of this material punched free from the side walls 5 and 6 through 180° toward the support element and the gas exchange valve 12 respectively, it is not only the retaining tabs 13 that are formed in the side walls 5 and 6 but also pockets 15.

Figure 2:
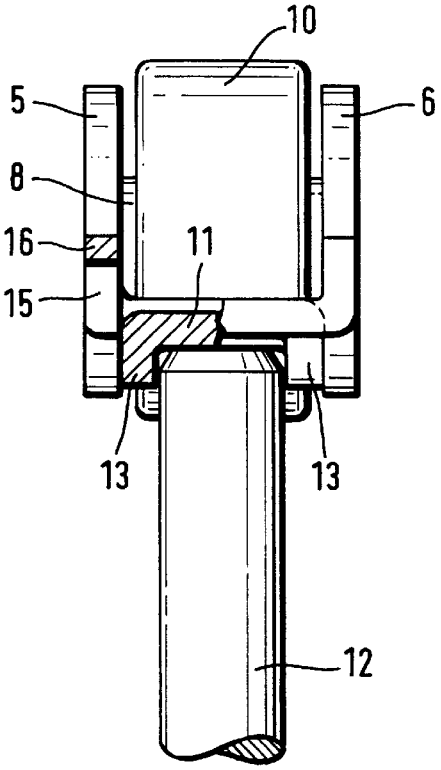
FIGS. 2 and 3 show a section through a finger lever along line A—A of FIG. 1.
Figure 3:
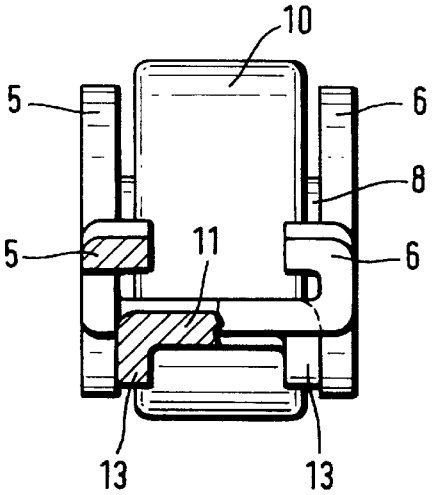
Figure 4:
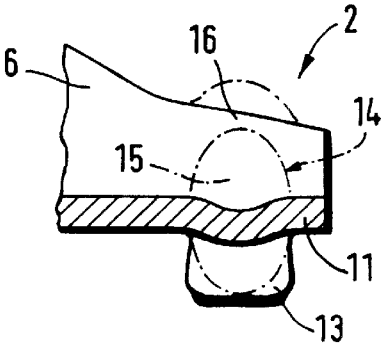
FIG. 4 shows a detail out of a side view of a finger lever, partly in section.

It can be seen in FIGS. 2 and 3 that the retaining tabs 13 extend parallel to the side walls 5 and 6 but are inwardly offset therefrom. The retaining tabs 13 may have different shapes, for example as shown in FIGS. 1 and 4, they may be trapezoid in shape. FIG. 4 further shows that the retaining tabs 13 can be re-stamped, i.e. their shape can be modified. The last-mentioned figure also shows that, after punching, the retaining tab 13 was originally semicircular in shape and was then modified into a into a trapezoid shape by re-stamping. FIGS. 1 to 4 further show that the upper boundary of the punched-out section 14 extends below the upper edge of the side walls 5 an 6, that is to say, the side walls 5 and 6 are not completely severed in their upper regions. In this way, the stability of the lever is assured. The figures also show that the shape of the upper edge of side walls 5 and 6 in the region of the punched-out section 14 is matched to the contour of the punched-out section, i.e., in FIG. 1, the upper part of the punched-out section 14 is more or less parallel to the side wall 5, i.e. straight, while in FIG. 4, both the punched-out section 14 and the side wall 5 have semicircular upper regions. FIG. 4 also clearly shows that the residual cross-section 16 formed by the punched-out section 14 can be displaced into the pocket 15 by a shaping process. Finally, FIG. 3 shows that in the region in front of and behind the retaining tabs 13, the side walls 5 and 6 are bent inward at right angles to improve stability.

What is claimed is:

1. A finger lever for a valve train of an internal combustion engine, said finger lever being made by shaping without chip removal and comprising two side walls (5, 6) which are connected to each other in a first end region (1) by a first bottom wall (4) to form an upwardly open U-shape, the first bottom wall (4) comprising a downwardly facing semi-spherical recess (7) for receiving a support element, said side walls (5, 6) being connected to each other in a second end region (2) by a second bottom wall (11) to form an upwardly open U-shape, said second bottom wall (11) comprising a contact surface for a valve stem of a gas exchange valve (12), and the contact surface comprising lateral guides spaced apart from each other characterized in that, in the region of the contact surface of the valve stem (12) and/or in the region of the semi-spherical recess (7), the side walls (5, 6) comprise partially punched-out sections (14) that are bent through nearly 180° toward the valve stem (12) and/or toward the support element respectively, so that retaining tabs (13) are formed for the lateral guidance of the finger lever on the valve stem (12) and/or on the support element.

2. A finger lever according to claim 1, characterized in that the upper boundary of the punched-out section (14) is situated below the upper edge of the side walls (5, 6).

3. A finger lever according to claim 1, characterized in that the shape of the upper edge of the side walls (5, 6) in the region of the punched-out section (14) is matched to the profile of the punched-out section (14).

4. A finger lever according to claim 1, characterized in that the residual cross-section (16) of the side walls (5, 6) formed by the partially punched-out section (14) is displaced into the pocket (15) formed by the bent-over retaining tab (13).

5. A finger lever according to claim 1, characterized in that the retaining tabs (13) have a rectangular, a trapezoid or a semicircular configuration.

6. A finger lever according to claim 1, characterized in that the retaining tabs (13) are subjected to an after-treatment of stamping.

7. A finger lever according to claim 1, characterized in that the retaining tabs (13) are parallel to or are bent to extend at a defined angle to the side walls (5, 6).

8. A finger lever according to claim 1, characterized in that the retaining tabs (13) are parallel to the side walls (5, 6) and are arranged inwardly offset from the side walls (5, 6).

9. A finger lever according to claim 1, characterized in that the upper edge of the side walls (5, 6) in the region in front of and behind the retaining tabs (13) is bent inward at a right angle.

* * * * *